United States Patent [19]

McGee et al.

[11] 4,172,719

[45] Oct. 30, 1979

[54] BRIQUETTE FOR SPOT HARDENING OF POWDER METAL PARTS

[75] Inventors: Sherwood W. McGee, Lisle, Ill.; Charles T. Shork, Claremore, Okla.

[73] Assignee: Amsted Industries Incorporated, Chicago, Ill.

[21] Appl. No.: 753,902

[22] Filed: Dec. 23, 1976

[51] Int. Cl.[2] ..... B22F 1/00

[52] U.S. Cl. ..... 75/230; 75/247; 75/208 R; 428/546; 75/214; 427/383 D

[58] Field of Search ..... 75/200, 208 R, 211, 75/214, 221, 228, 230, 247; 428/546; 427/383 D, 192; 106/1.13, 1.18

[56] References Cited

U.S. PATENT DOCUMENTS

| | | | |
|---|---|---|---|
| 2,606,831 | 8/1952 | Koehring | 75/200 |
| 2,817,601 | 12/1957 | Shigley | 75/208 R |
| 2,928,755 | 3/1960 | Brandstadt et al. | 427/192 |
| 3,091,029 | 5/1963 | Davis et al. | 106/1.13 |
| 3,459,547 | 8/1969 | Andreotti et al. | 75/208 R |
| 3,619,170 | 11/1971 | Fisher | 75/208 R |
| 3,823,002 | 7/1974 | Kirby et al. | 75/230 |
| 3,994,734 | 11/1976 | Cuthbert | 75/247 |

OTHER PUBLICATIONS

Winterton et al., Chem. Abs., 66:79136t, (1967).

*Primary Examiner*—Ralph S. Kendall
*Attorney, Agent, or Firm*—John L. Schmitt; Fred P. Kostka

[57] ABSTRACT

A local zone only of a powdered metal part is hardened by heating the part, in contact with a powdered metal alloy briquette with a surface of the zone to be locally hardened, to the liquidus range of the briquette and holding the part and the briquette at the liquidus range for a length of time sufficient for the liquid metal and hardening elements of the briquette to infiltrate into the local zone of the part.

2 Claims, 5 Drawing Figures

BRIQUETTE FOR SPOT HARDENING OF POWDER METAL PARTS

In the past, powdered metal parts have been hardened by various standard methods which require special furnaces, special heat treatments, or the like. Because of the special equipment required, or the time element involved, such prior art hardening techniques greatly increased the cost of the powdered metal part.

It is a primary object of the present invention to locally harden a powdered metal part for increased wear resistance, and preferably accomplish this during the normal sintering operation, thereby eliminating the need for more costly induction hardening or other methods of localized hardening.

Generally, the novel process contemplates compacting a hardening material and an infiltrating material into a briquette having a shape corresponding to an area of the zone to be hardened of a powder metal part, placing the briquette on the part, and sintering the part and the briquette in an endothermic atmosphere furnace at a temperature of about 2075° F. for about eight minutes at temperature. The powder metal part, as it comes from the furnace, is locally hardened to a depth of about 0.050" in the range of about 30–57 Rockwell "C."

The invention will be more readily understood from the following description and accompanying drawings wherein.

Figure 1:
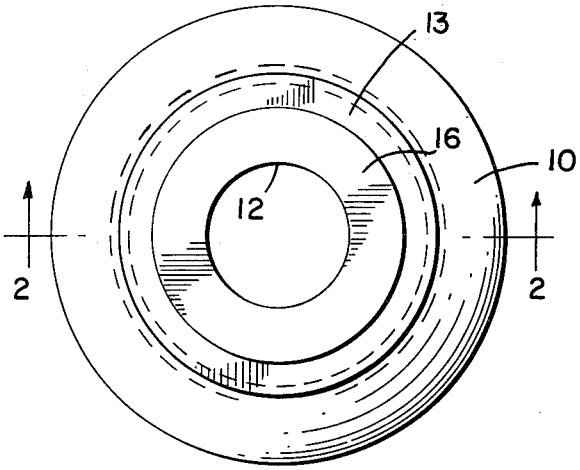
FIG. 1 is a top view of a typical powder metal part with a spot hardening briquette covering the surface of the local zone to be hardened.
Figure 2:
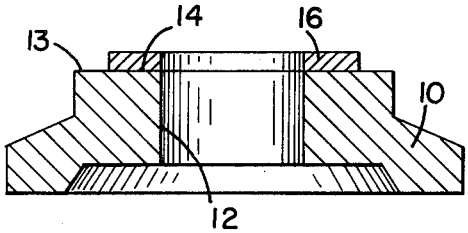
FIG. 2 is a vertical sectional view taken along line 2—2 of FIG. 1.

FIGS. 1 and 2 illustrate a typical machine part 10, which in this instance is a ferrous powder metal gear having a bore 12 and a face 13 which is to be locally hardened in the zone 14. As will be explained in detail hereinafter, the zone 14 is hardened by sintering the part 10 while an outer surface of the zone 14 is in contact with a hardening briquette 16 which is contoured to the specific shape of the zone to be hardened, in this instance, a circumferential band adjacent the bore 12.

The briquette 16 is a powder metal part formed of a plurality of components each having a specific function. Essentially the briquette will include (a) a component which will promote hardenability in the ferrous metal part, comprising one or more constituents such as manganese aided by nickel, (b) a component to promote initial fluidity in the briquette, such as phosphorus, (c) a transport component, such as copper, to carry the hardenability component into the ferrous metal part, (d) a matrix forming component, such as graphite aided by manganese, to confine the hardening reaction to the specific area of the zone and (e) the components are compacted to a density to limit a depth of penetration of the infiltrating materials. Note, phosphorus also may aid this limiting function. It may also be advantageous to include a lubricating component such as zinc stearate which will facilitate the mixing of the components and compaction of the briquette.

A portion of the manganese is utilized in the form of powder of 99.5% purity. However, pure manganese tends to oxidize to form MnO and it is this portion of the manganese in the form of MnO which works with the graphite to form the matrix. Most of the manganese is furnished as an element of a prealloyed bronze powder which has been atomized and annealed. This portion of the manganese is that which, aided by nickel to minimize brittleness, contributes to the hardenability of the ferrous powder metal part. The bronze alloy also contributes the desired amount of copper, the transport component.

Nickel, which contributes to hardenability along with the manganese and phosphorus and which counteracts the tendency of the manganese to cause brittleness, is added as a carbonyl type powder with a subsieve mesh size of three microns maximum. A small amount of nickel is also furnished by the bronze alloy powder.

The graphite is a natural flake powder which is 97% pure and has been sifted to a subsieve mesh size of three microns maximum.

The phosphorus is furnished as a phosphorus—iron alloy powder which has been shotted and milled and has a mesh size of about −150. Pure phosphorus, as is well known, is not entirely safe to handle, has a short shelf life and, having a high vapor pressure, evaporates quickly. It therefore is generally used in an alloy which tends to stabilize it. The phosphorus could be alloyed with iron, or with copper and/or nickel, but iron is preferred because it is the least expensive.

The following are specific examples of locally hardening a ferrous powder metal part by the proposed method.

EXAMPLE A

A ferrous powder metal part, such as shown at 10 in FIG. 1, having a minimum density of 6.8 gr/cc, was spot hardened in the zone 14 by means of a briquette 16 having the following composition:

3% by weight—Glidden P-120 Ferro-phosphorus
3% by weight—Inco 123 Nickel
1% by weight—Glidden E-130 Manganese
1% by weight—Southwestern 1651 Graphite
58% by weight—Greenback 632 Prealloy bronze
34% by weight—Amax Infalloy Prealloy bronze The above composition has the following chemical analysis:

| Constituent | Percentage By Weight of Mix | Analysis-Percent | Mesh Size U.S. Sieve Series or as noted |
|---|---|---|---|
| Phosphorus-Iron Alloy powder, shotted & milled | 3.0 | P: 24.0<br>Fe: 75.5<br>Si: 1.0 max | −150 |
| Nickel powder, carbonyl type | 3.0 | Ni: 99.7<br>Fe: 0.15 max<br>Co: 0.15 max | Subsieve size 5 microns max. |

-continued

| Constituent | Percentage By Weight of Mix | Analysis-Percent | Mesh Size U.S. Sieve Series or as noted |
|---|---|---|---|
| Graphite powder Natural flake-sifted | 1.0 | C: 97.0 min<br>Si: 3.0 max | Subsieve size<br>3 microns max |
| Manganese powder electrolytic | 1.0 | Mn: 99.5<br>Fe: 0.05 max | −150 |
| Prealloyed Bronze powder, atomized & annealed Greenback 632 | 58.0 | Cu: 92.0<br>Fe: 4.5<br>Mn: 3.0<br>Ni: 0.5 | −100 |
| Prealloyed Bronze powder, atomized & annealed Amax Infalloy | 34.0 | Cu: 91.5<br>Fe: 4.75<br>Mn: 1.25<br>Ni: 0.5<br>other Bal. | −100 |

The constituents of the composition of the above table break down into the components listed in the following table. The table also indicates the function of the components as they relate to the spot hardening briquettes formed from the composition as well as the percentages by weight of each functional component. It will be understood that "constituent" refers to each individual element of the composition, while "component" refers to one or more elements of the composition which perform a specific function in carrying out the method of locally hardening a powder metal part.

| Element | Percentage By Weight of Mix | Percentage of Functional Component By Weight of Mix | Function of Component |
|---|---|---|---|
| Phosphorus | 0.72 | 0.72 | Promotes initial liquid-solid diffusion; fluidity |
| Graphite | 0.97 | | Matrix-to |
| Manganese converted to MnO | 1.00 | 1.97 | localize zone of hardening |
| Manganese from bronze | 2.16 | 5.61 | Promote hardenability |
| Nickel | 3.45 | | |
| Copper | 84.47 | 84.47 | Transport medium |
| Iron | 6.58 | 6.58 | Not essential |
| Si-Co | trace | trace | Not essential |

The Amax prealloy bronze powder was supplied premixed with about 1% by weight of zinc stearate, which later facilitates compacting the constituents into a briquette. All ingredients except the Amax bronze were mixed for ten minutes, and screened through a 60 mesh screen to break up all conglomerates. The Amax bronze was then added and the mixing continued until all the constituents were dispersed with the completed mix meeting the following requirements:

(a) Flow rate by ASTM method B213-48, 120 seconds
(b) Apparent density by ASTM method B212-48, 2.55 to 2.70 gr/cc
(c) Compressability by ASTM method B331-64, 30 TSI, 7.0 gr/cc minimum The hardening mix was compacted, at 25 TSI using a one inch die and a three-eighths inch core rod, into the desired briquette shape and placed on the surface to be hardened of the ferrous metal part.

It should be noted that the work piece to be spot hardened may be green, presintered, or full sintered prior to spot hardening. However, in the present example, the sintering and spot hardening were accomplished simultaneously by placing the work piece, with the hardening briquette thereon, in a sintering furnace having an endothermic atmosphere. The preferred hearth temperature is 2075° F. with a normal range of control of ±15°. It has been found that for specific applications, spot hardening temperatures may be as low as 1990° F. and as high as 2350° F. depending on the desired sintered properties.

The preferred furnace atmosphere is normal endothermic cracked natural gas of the following nominal composition:

$H_2$—20.0%
CO—16.0%
$CO_2$—2.0%
$H_2O$—0.8%
$N_2$—Balance

Other suitable atmospheres include the following:

(a) Exothermic with the composition
$H_2$—9.0%
CO—9.0%
$CO_2$—6.0%
$H_2O$—1.5%
$N_2$—Balance
(b) Dissociated ammonia with the composition
$H_2$—30.0%
$H_2O$—0.25% max
$N_2$—Balance
(c) Dry nitrogen
$N_2$—99.9%
$H_2O$—0.10% max
(d) Vacuum—typical for commercial heat treating and may typically include small amounts of nitrogen and methane.

The choice of atmospheres is determined by the necessity of avoiding excessive oxidation to either the work piece or the spot hardening briquette prior to or during the melt down process, and the permissible carbon changes within the powder metal work piece.

The depth of hardening in the ferrous metal work piece, or part that is being spot hardened, may be defined as the distance from the part's surface at which 50% of the microstructure is martensitic with the martensitic particle hardness (as determined using 100 gram Knoop) being at least 50 and preferably 55–65 Rockwell "C" equivalent. The apparent hardness of the hardened areas of samples made under Example A ranged from 30 to 50 Rockwell "C."

The depth of spot hardening is controlled largely by the weight per unit area, or contact pressure exerted by the spot hardening briquette. In the present example the contact pressure was about 22 grams per square inch and the depth of hardening was 0.050 inches.

It has been found that, generally, a contact pressure of at least 20 to 25 grams per square inch must be exerted by the hardening briquette upon the surface of the zone to be hardened in order to achieve a satisfactory hardened depth. Lower contact pressures usually result in shallower hardened depths but in some instances this may be desirable. In any event, the contact pressures must be determined for each type of work piece depending on the metallurgy, the size and shape of the area to be hardened, and the desired depth of hardness. It has been determined, for example, that for hardening pockets or counterbores, a lower contact pressure factor may be used.

EXAMPLE B

Ferrous powder metal parts were spot hardened by means of a hardening briquette having the following composition:

| Constituent | Percentage By Weight of Mix | Analysis-Percent | Mesh Size U.S. Sieve Series or as noted |
|---|---|---|---|
| Phosphorus-iron alloy powder, shotted & milled | 3.0 | P: 24.0<br>Fe: 75.5<br>Si: 1.0 max | −150 |
| Nickel powder, carbonyl type | 3.0 | Ni: 99.7<br>Fe: 0.15 max<br>Co: 0.15 max | Subsieve size 5 microns max |
| Natural flake graphite powder, sifted | 1.0 | C: 97.0 min<br>Si: 3.0 max | Subsieve size 3 microns max |
| Manganese powder, electrolytic | 1.0 | Mn: 99.5<br>Fe: 0.05 max | −150 |
| Prealloyed bronze powder-atomized & annealed | 92.0 | Cu: 92.0<br>Fe: 4.5<br>Mn: 3.0<br>Ni: 0.5 | −100 |

The above composition breaks down into the chemical analysis shown in the following table which also shows the percentages of the functional components together with an indication of the function performed by each component.

| Element | Percentage By Weight of Mix | Percentage of Functional Component By Weight of Mix | Function of Component |
|---|---|---|---|
| Phosphorus | 0.72 | 0.72 | Promotes initial liquid-solid diffusion; fluidity |
| Graphite | 0.97 | | Matrix to |
| Manganese converted to MnO | 1.00 | 1.97 | localize zone of hardening |
| Manganese from bronze | 2.76 | 6.21 | Promote hardenability |
| Nickel | 3.45 | | |
| Copper | 84.64 | 84.64 | Transport medium |
| Iron | 6.41 | 6.41 | Not essential |
| Si-Co | trace | trace | Not essential |

The bronze powder once again was supplied premixed with about 1% by weight of zinc stearate and all of the ingredients were mixed together for about fifteen minutes. The apparent density of the mix was about 2.6 gr/cc with a Hall flow rate of 2 minutes, tap, typical. The mix was compacted at about 30 TSI into a briquette of the desired shape and of a sufficient thickness to provide a contact pressure of 25 grams per square inch.

The sintering was carried out as in Example A and the parts showed an apparent hardness, in the area under the hardening briquette, of 50 Rockwell "C" to a depth of 0.050". The particle hardness of the hardened portion was about 60 Rockwell "C" converted from 100 gram knoop.

EXAMPLE C

A 25 tooth, 12 pitch spur gear of 2.060" pitch diameter and 0.470" face width, with a 0.593" diameter bore required local hardening to a depth of 0.035" to 0.050" in a circular zone 0.20" wide around the bore. The gear material was sintered nickel steel (0.70 C., 2.0 Ni, bal. Fe) of 6.9 gr/cc density. Spot hardening briquettes for hardening the zone were 0.600" I.D., 1.060" O.D. and 0.265" thick, with a green density of 7.3 gr/cc, were compacted from the following constituents:

| Constituent | By Weight of Mix | Analysis-Percent | Mesh Size U.S. Sieve Series or as noted |
|---|---|---|---|
| Phosphorus-Nickel alloy powder shotted & milled | 8.0 | P: 12.0<br>B: 0.01<br>Ni: 87.99 | −150 |
| Graphite powder, natural flake, sifted | 2.0 | C: 97.0 min<br>Ash: Balance | Subsieve size 3 microns max |
| Prealloyed bronze powder; atomized & annealed | 90.0 | Cn: 90.0<br>Mn: 5.0<br>Fe: 5.0 | −100 |

The above composition breaks down into the chemical analysis shown in the following table which once again shows the percentages of the functional components together with an indication of the function performed by each component. It will be noted that in this Example, no addition of electrolytic manganese powder was made. Instead, all of the required manganese including the portion which is converted to manganese oxide which acts with the graphite to form the matrix, and also the manganese which promotes hardenability are derived from the manganese in the prealloyed bronze. In this regard, it is estimated that from 5% to 10% of the manganese is converted to manganese oxide and, on this basis, 7½% has been utilized in the following table.

| Element | Percentage By Weight of Mix | Percentage of Functional Component By Weight of Mix | Function of Component |
|---|---|---|---|
| Phosphorus | 0.96 | 0.96 | Promotes initial liquid-solid diffusion; liquidity |
| Graphite | 1.94 | | Matrix to localize zone of hardening |
| Manganese converted to MnO | 0.34 estimated | 2.28 | |
| Manganese from bronze | 4.16 estimated | 11.20 | Promote hardenability |
| Nickel | 7.04 | | |
| Copper | 81.00 | 81.00 | Transport medium |
| Iron | 4.50 | 4.50 | Not essential |
| Zn, $N_2$, $O_2$, B | trace | trace | Not essential |

The bronze powder, as in Examples A and B, was supplied premixed with about 1% by weight of zinc stearate lubricant and all of the ingredients were mixed and compacted into briquettes as described heretofore. Both the spot hardening and the sintering were accomplished in a single furnace pass in a normal endothermic atmosphere at a temperature of 2080° F.±20° F. The gears were held in the sintering zone for about 20 minutes and were then cooled under controlled endothermic atmosphere to room temperature in approximately 70 minutes. All of the desired results were achieved and the cost involved was much less than if flame hardening or induction hardening methods had been used.

While the foregoing examples have been directed to locally hardening a part, such as illustrated at 10 in FIGS. 1 and 2, by an annular cylindrically shaped briquette as illustrated at 16, it is possible to carry out the process on ferrous powder metal parts of other configurations.

Figure 3:
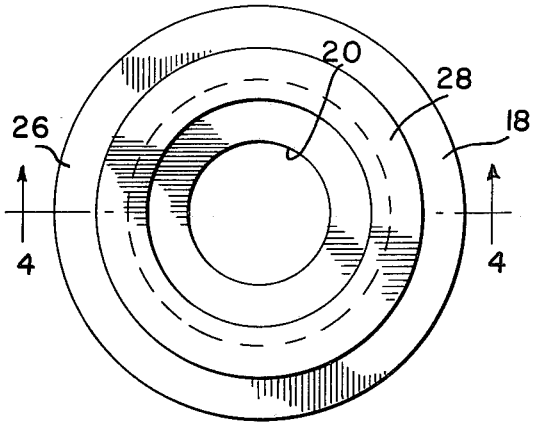
FIG. 3 is a top view of another powder metal part and hardening briquette.
Figure 4:
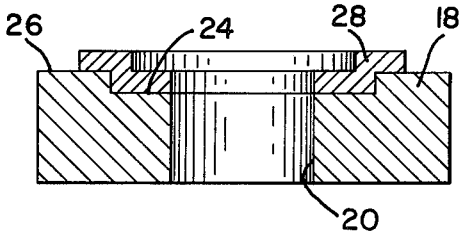
FIG. 4 is a sectional view taken along line 4—4 of FIG. 3.

FIGS. 3 and 4, for example, show a ferrous powder metal part 18 having a bore 20, and a counterbore 24 in face 26. The zone to be locally hardened comprises the bottom and sides of the counterbore and a portion of the face 26. To accomplish this, a hardening briquette 28 is formed, as described heretofore in examples A, B and C, to the contour shown in FIG. 4 so that it is in intimate contact with the surfaces of the zone to be hardened. The part 18 and briquette 28 are then sintered as in the foregoing examples.

Figure 5:
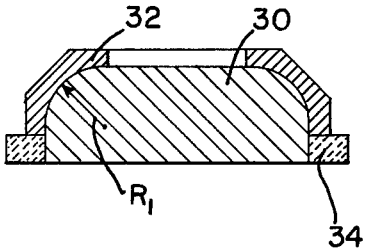
FIG. 5 is a sectional view, similar to FIGS. 2 and 4, of another powder metal part illustrating how a curved surface may be spot hardened.

FIG. 5 is a cross-sectional view of a circular ferrous powder metal part 30 which, for purposes of illustration, is to be locally hardened around the peripheral surface defined by $R_1$. In this instance, the hardening briquette 32 which is in contact with the surface of the zone to be hardened must be supported by a graphite ring 34 so that, during the sintering step when the briquette reaches the liquidus-solidus diffusion state, it will merge into the hardening zone of the work piece rather than flowing uselessly away from the work piece.

While three specific examples of briquette compositions have been given by way of illustration, it will be apparent that some variation in the proportions of the functional components will achieve the desired results. Tests, for example, have indicated that phosphorus may be present in the range of about 0.25% to 1.0%; the matrix forming components, namely graphite and manganese (converted to MnO) may be present in the range of about 1.0% to 5.0%; the hardenability component may be present in the range of about 3.0% to 12.5%; and the transport component, namely copper, may be present in the range of about 77.0% to 90.0%, all by weight.

I claim:

1. A briquette for spot hardening a ferrous powdered metal part, the briquette being formed to contact a zone of the part to be hardened, the briquette being a powdered metal alloy and comprising a component which promotes fluidity upon heating, a matrix forming component to confine the hardening reaction to an area of the zone to be spot hardened, a component to promote hardenability in the powdered metal part, and a transport component for carrying the hardenability component into the zone of the part, and said components being compressed to a density to selectively control a depth of said zone, said briquette further characterized wherein the fluidity promoting component comprises a phosphorus powder present in the range of about 0.25% to 1.0%, the matrix forming components comprise a graphite powder and a manganese powder present in the range of about 1.0% to 5.0%, the hardenability components comprise a nickel powder and a manganese powder present in the range of about 3.0% to 12.5%, and the transport component comprises a copper powder present in the range of about 77.0% to 90.0%, all percentages by weight, wherein said briquette is placed in contact with an outer surface of said zone of said part to be hardened, said part and said briquette are placed in an oven and heated in an endothermic atmosphere to a temperature proximating 2075° F. for a sufficient period of time to selectively change components of said briquette into a liquid state to infiltrate said zone and then said part is selectively cooled to produce a hardness in said zone having a selective high value.

2. A briquette for hardening a selective zone of a part, said briquette comprising, a briquette body having a preformed configuration of a powder mix compressed to produce a contact pressure area proximating 25 grams per square inch with said contact pressure area having a size proximating a size of an outside surface of said part zone, said briquette body further including, a phosphorous alloy powder having a particle size proximating 150 mesh size to produce in a liquid state a liquidity component in a range by weight of said briquette proximating 0.25 to 1.0%, a graphite powder having a particle size proximating 3 microns to produce a first localizing component, a manganese powder having a particle size proximating 150 mesh size to produce in a liquid state a second localizing component, said first and second localizing components having a range by weight of said briquette proximating 1.0–5.0%, a bronze alloy powder having a particle size proximating 100 mesh size to produce in a liquid state a transport component in a range by weight proximating 77–90% and a first hardenability component, and a nickel powder having a particle size proximating 5 microns to produce in a liquid state a second hardenability component, said first and second hardenability components having a range by weight of said briquette proximating 3–15%, wherein said briquette being placed with said part such that said briquette contact area interfaces with said part zone, said part and said briquette being heated to a temperature proximating 2075° F. to cause said powders of said briquette to selectively transform to said liquid state and infiltrate said zone, said part being cooled to produce a hardness in said zone having a selective high value.

* * * * *